US007880697B2

(12) United States Patent
Choi et al.

(10) Patent No.: US 7,880,697 B2
(45) Date of Patent: Feb. 1, 2011

(54) ORGANIC LIGHT-EMITTING DIODE DISPLAY DEVICE AND METHOD FOR DRIVING THE SAME

(75) Inventors: Beohm-Rock Choi, Seoul (KR); Kyong-Tae Park, Euijeongbu-si (KR); Young-Rok Song, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 742 days.

(21) Appl. No.: 11/843,977

(22) Filed: Aug. 23, 2007

(65) Prior Publication Data

US 2008/0068310 A1 Mar. 20, 2008

(30) Foreign Application Priority Data

Sep. 14, 2006 (KR) ..... 10-2006-0089137

(51) Int. Cl.
*G09G 3/30* (2006.01)

(52) U.S. Cl. ..... 345/77; 345/83

(58) Field of Classification Search ..... 345/76, 345/77, 82, 83, 88, 89, 690; 315/169.3
See application file for complete search history.

(56) References Cited

U.S. PATENT DOCUMENTS

2004/0222999 A1* 11/2004 Choi et al. ..... 345/77
2006/0066252 A1* 3/2006 Kim ..... 315/169.3

* cited by examiner

*Primary Examiner*—Kevin M Nguyen
(74) *Attorney, Agent, or Firm*—H.C. Park & Associates, PLC

(57) ABSTRACT

An organic light-emitting diode (OLED) display panel includes a plurality of pixels displaying a plurality of colors. Each pixel has an OLED element. A gamma voltage-generating section generates a reference gamma voltage based on a gamma curve in which the lowest gradation of the total number of gradations is mapped as a negative data voltage with respect to a reference voltage. A data conversion section converts a first data signal into a second data signal that includes data corresponding to the lowest gradation. A source drive section converts the second data signal into a third data signal by using the reference gamma voltage to provide the OLED display panel with the third data signal.

7 Claims, 6 Drawing Sheets

P1

P2

P3

ORGANIC LIGHT-EMITTING DIODE DISPLAY DEVICE AND METHOD FOR DRIVING THE SAME

CROSS-REFERENCE TO RELATED APPLICATIONS

This application claims priority to and the benefit of Korean Patent Application No. 10-2006-0089137, filed on Sep. 14, 2006, which is hereby incorporated by reference for all purposes as if fully set forth herein.

BACKGROUND OF THE INVENTION

1. Field of the Invention

The present invention relates to an organic light-emitting diode (OLED) display device and a method for driving the OLED display device. More particularly, the present invention relates to an OLED display device that may have an increased lifetime and a method for driving the OLED display device.

2. Discussion of the Background

Generally, a unit pixel of an organic light-emitting diode (OLED) display device includes a switching transistor TRs, a storage capacitor CST, a driving transistor TRd, and an organic electroluminescence (EL) element. The switching transistor TRs switches a data signal in response to a gate signal. The storage capacitor CST stores the data signal during one frame interval. The driving transistor TRd provides the EL element with a bias voltage corresponding to the data signal. The EL element is electrically connected to a common voltage, and it emits light in response to a current corresponding to the bias voltage that is transferred from the driving transistor TRd.

When the same polarity data voltage is continuously applied to a gate of an amorphous silicon thin-film transistor (a-Si TFT), the a-Si TFT's output characteristics gradually deteriorate (or suffer gradual failure). That is, with a driving transistor TRd that controls an output current in response to the gate voltage, when the same polarity data voltage (i.e., a positive polarity voltage with respect to a common voltage Vcom) is applied to the gate of the driving transistor TRd for a long time, the a-Si TFT's output characteristics gradually deteriorate.

In order to prevent deterioration of the a-Si TFT, during an interval in which the EL element is not emitting light, a signal having a different polarity from a polarity of the data signal may be applied to the driving transistor TRd. However, including the additional interval to apply the signal having the different polarity voltage may not be desirable.

SUMMARY OF THE INVENTION

The present invention provides an organic light-emitting diode (OLED) display device that may be capable of increasing the lifetime thereof by applying a data conversion method.

The present invention also provides a method for driving the OLED display device.

Additional features of the invention will be set forth in the description which follows, and in part will be apparent from the description, or may be learned by practice of the invention.

The present invention discloses an OLED display device including an OLED display panel, a gamma voltage-generating section, a data conversion section, and a source drive section. The OLED display panel includes a plurality of pixels that emit a plurality of colors, respectively. Each pixel has an OLED element. The gamma voltage-generating section generates a reference gamma voltage based on a gamma curve in which the lowest gradation of all gradations is mapped as a negative data voltage with respect to a reference voltage. The data conversion section converts a first data signal input from an external device into a second data signal that includes data corresponding to the lowest gradation. The source drive section converts the second data signal into a third data signal of an analog type by using the reference gamma voltage to provide the OLED display panel with the third data signal.

The present invention also discloses a method for driving an OLED display device. The OLED display device includes an OLED display panel with a plurality of pixels that emit a plurality of colors, respectively. Each pixel has an OLED element. According to the driving method, a first data signal is converted into a second data signal including a lowest gradation. Then, the lowest gradation of the second data signal is converted into a negative data voltage based on a reference voltage, and a gradation of the second data signal that is higher than the lowest gradation is converted into a positive data voltage with respect to the reference voltage. Then, the data voltages are output to the OLED display panel.

The present invention also discloses a display device including a display panel, a gamma voltage-generating section, a data conversion section, and a source drive section. The display panel includes a plurality of unit pixels. Each unit pixel includes a first sub-pixel, a second sub-pixel, a third sub-pixel, and a fourth sub-pixel. The gamma voltage-generating section generates a reference gamma voltage based on a gamma curve in which the lowest gradation of all gradations is mapped as a negative data voltage with respect to a reference voltage. The data conversion section converts a first data signal into a second data signal. The second data signal includes a first sub-pixel data signal, a second sub-pixel data signal, a third sub-pixel data signal, and a fourth sub-pixel data signal, and at least one of the four sub-pixel data signals is always set to the lowest gradation. The source drive section converts the second data signal into a third data signal by using the reference gamma voltage to provide the third data signal to the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
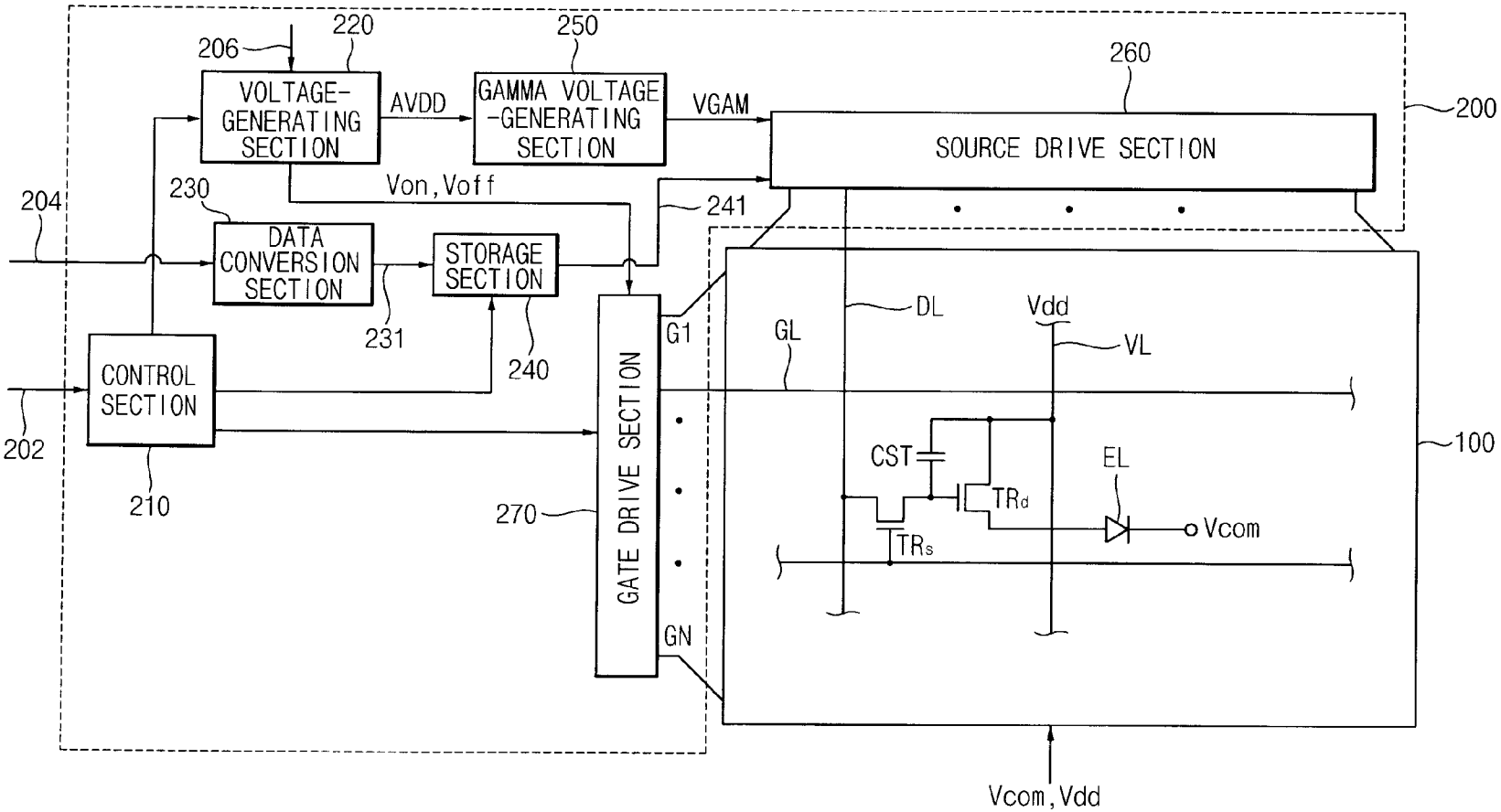
FIG. 1 is a block diagram showing an organic light-emitting diode (OLED) display device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be described in detail with reference to the accompanying drawings.

Figure 2A:
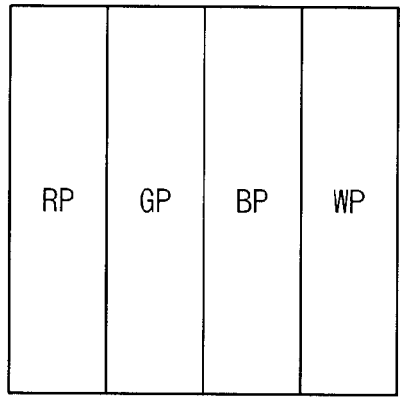
FIG. 2A, FIG. 2B, and FIG. 2C are plan views showing various structures of a unit pixel part.
Figure 2B:
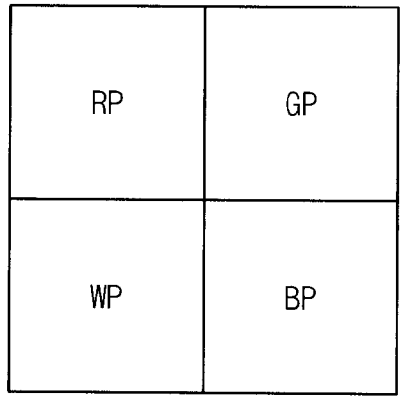
Figure 2C:
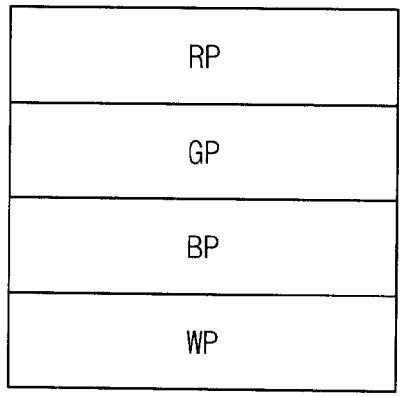
Figure 3:
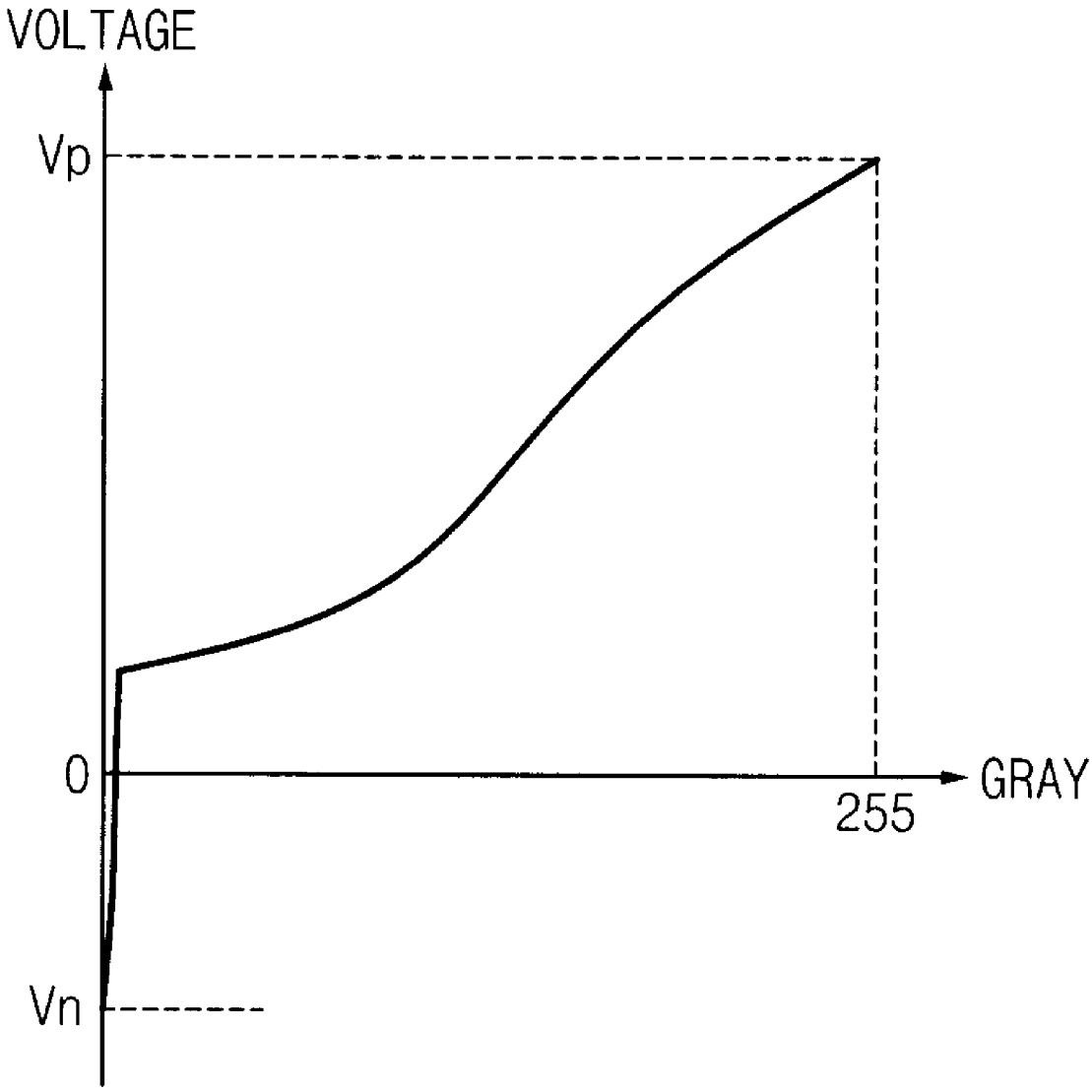
FIG. 3 is a gamma curve that is applied in the gamma voltage-generating section of FIG. 1.

FIG. 1 is a block diagram showing an organic light-emitting diode (OLED) display device according to an exemplary embodiment of the present invention. FIG. 2A, FIG. 2B, and FIG. 2C are plan views showing various structures of a unit pixel part. FIG. 3 is a gamma curve that is applied in the gamma voltage-generating section of FIG. 1.

Referring to FIG. 1, an OLED display device according to an exemplary embodiment of the present invention includes an OLED display panel 100 and a panel driving section 200.

The OLED display panel 100 includes a plurality of unit pixel parts. Each unit pixel part includes a first sub-pixel RP that emits red light, a second sub-pixel GP that emits green light, a third sub-pixel BP that emits blue light, and a fourth sub-pixel WP that emits white light.

Each sub-pixel RP, GP, BP, and WP includes a switching transistor TRs, a driving transistor TRd, a storage capacitor CST, and an organic electroluminescence (EL) element EL to emit light.

The switching transistor TRs includes a gate electrode electrically connected to a gate line GL, a source electrode electrically connected to a data line DL, and a drain electrode electrically connected to the storage capacitor CST and the driving transistor TRd. A first terminal of the storage capacitor CST is electrically connected to the switching transistor TRs, and a second terminal of the storage capacitor CST is electrically connected to a driving voltage line VL.

The driving transistor TRd includes a gate electrode electrically connected to the switching transistor TRs, a source electrode electrically connected to the driving voltage line VL to receive a bias voltage Vdd, and a drain electrode electrically connected to the organic EL element EL. The organic EL element EL includes an anode electrically connected to the driving transistor TRd and a cathode electrically connected to a reference voltage Vcom.

A unit pixel of the OLED display panel 100 may have various structures as shown in FIG. 2A, FIG. 2B, and FIG. 2C.

A structure of a unit pixel part P1 shown in FIG. 2A includes the first, second, third, and fourth sub-pixels RP, GP, BP, and WP arranged in a horizontal strip shape, and a structure of a unit pixel part P2 shown in FIG. 2B includes the first, second, third, and fourth sub-pixels RP, GP, BP, and WP arranged in a matrix shape. A structure of a unit pixel part P3 shown in FIG. 2C includes the first, second, third, and fourth sub-pixels RP, GP, BP, and WP arranged in a vertical strip shape.

The panel driving section 200 includes a control section 210, a voltage-generating section 220, a data conversion section 230, a storage section 240, a gamma voltage-generating section 250, a source drive section 260, and a gate drive section 270.

The control section 210 generates a driving control signal based on a primary control signal 202 provided from a graphics controller (not shown). The control section 210 controls the voltage-generating section 220, the data conversion section 230, the storage section 240, the gamma voltage-generating section 250, the source drive section 260, and the gate drive section 270 based on the driving control signal.

The voltage-generating section 220 uses a provided voltage 206 to generate a first driving voltage, a second driving voltage, and a third driving voltage for driving the OLED device. The first driving voltage includes a power voltage AVDD for driving the gamma voltage-generating section 250. The second driving voltage includes a gate turn-on voltage Von and a gate turn-off voltage Voff for driving the gate drive section 270. The third driving voltage includes a reference voltage Vcom and a bias voltage Vdd for driving the OLED display panel 100. For example, the reference voltage Vcom is applied to the cathode of the organic EL element EL, and the bias voltage Vdd is applied to the driving voltage line VL.

The data conversion section 230 converts a first data signal 204 input from the graphics controller into a second data signal 231 corresponding to the OLED display panel 100, and then outputs the second data signal 231 to the storage section 240.

For example, the data conversion section 230 may convert the first data signal 204 of three colors into the second data signal 231 of four colors, and then may output the second data signal 231 to the storage section 240. Here, the first data signal 204 includes first red data R, first green data G, and first blue data B, and the second data signal 231 includes second red data R', second green data G', second blue data B', and white data W. At least one component of the second data signal R', G', B', and W has a gradation of zero.

The storage section 240 stores the second data signal R', G', B', and W, which is provided from the data conversion section 230, by a horizontal line unit or a frame unit. The storage section 240 reads out the second data signal R', G', B', and W corresponding to a horizontal line based on the driving control signal provided from the control section 210. A readout sequence of the second data signal R', G', B', and W corresponds to the pixel structure of the OLED display panel 100.

The gamma voltage-generating section 250 uses a gamma curve to generate a reference gamma voltage VGAM that corresponds to a predetermined number of reference gradations of the total number of gradations of the second data signal R', G', B', and W. The gamma curve is shown in FIG. 3.

Referring to FIG. 3, when there are 256 total gradations, gradations of 1 to 255 are mapped as a positive polarity data voltage with respect to the reference voltage Vcom, and a gradation of zero is mapped as a negative polarity data voltage with respect to the reference voltage Vcom.

Therefore, according to the gamma curve, color data having a gradation of zero of the second data signal R', G', B', and W is output as a negative data voltage. The color data having a gradation of zero of the second data signal R', G', B', and W exists randomly, so that positive and negative polarity data voltages may be applied to each driving transistor TRd of the first to third sub-pixels RP, GP, and BP so that deterioration of the driving transistor TRd may be decreased. Since the W portion of the second data signal may also have a gradation of zero, positive and negative polarity data voltages may also be applied to the driving transistor TRd of the fourth sub-pixel WP.

The source drive section 260 converts the second data signal R', G', B', and W provided from the storage section 240 into a third data signal r', g', b', and w', which is an analog signal, based on the reference gamma voltage VGAM. The third data signal r', g', b', and w' are output to data lines $DL_1$ to $DL_M$ of the OLED display panel 100 based on the driving control signal.

The gate drive section 270 generates a plurality of gate signals $G_1$ to $G_N$ in response to the driving control signal, and then sequentially provides the gate signals $G_1$ to $G_N$ to the gate lines $GL_1$ to $GL_N$ of the OLED display panel 100.

Figure 4:
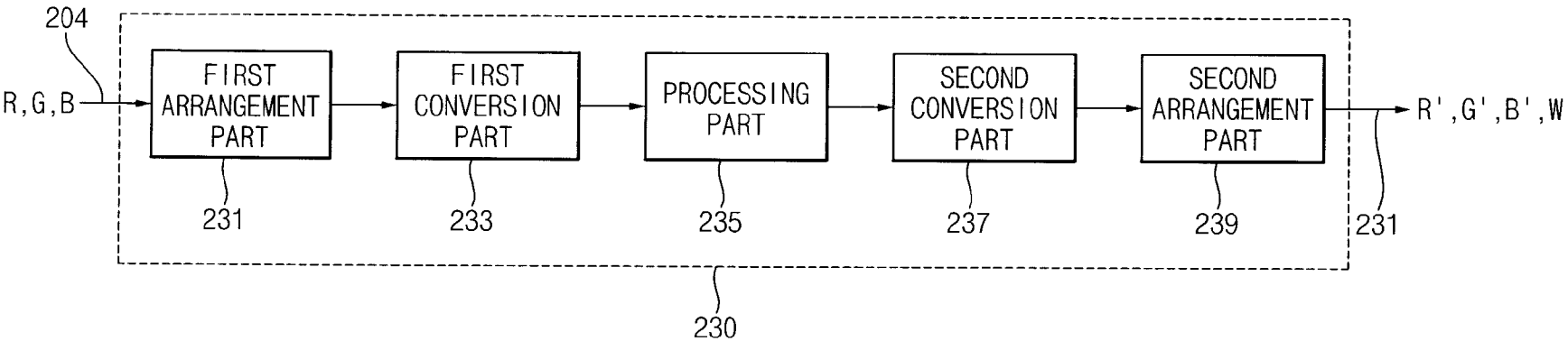
FIG. 4 is a block diagram showing the data conversion section of FIG. 1.

FIG. 4 is a block diagram showing the data conversion section of FIG. 1.

Referring to FIG. 1 and FIG. 4, the data conversion section 230 includes a first arrangement part 231, a first conversion part 233, a processing part 235, a second conversion part 237, and a second arrangement part 239.

The first arrangement part 231 arranges the first data signal 204, which includes first red data R, first green data B, and first blue data B, in the order of gradation size (i.e., Max, Mid, Min).

The first conversion part 233 converts the arranged first data signal into first luminance data aMax, second luminance data aMid, and third luminance data aMin, and then provides the processing part 235 with the first to third luminance data aMax, aMid, and aMin.

The processing part 235 extracts maximum luminance data wMax, middle luminance data wMid, minimum luminance data wMin, and white luminance data wW by processing the first, second, and third luminance data aMax, aMid, and aMin.

The maximum, middle, minimum, and white luminance data wMax, wMid, wMin, and wW is defined by Equations 1, 2, 3, and 4, respectively.

$$wMax = aMax - aMin \quad \text{Equation 1}$$

$$wMid = aMid - aMin \quad \text{Equation 2}$$

$$wMin = 0 \quad \text{Equation 3}$$

$$wW = aMin \quad \text{Equation 4}$$

According to Equations 1 to 4, the minimum luminance data wMin may always have a zero value.

The second conversion part 237 converts the maximum, middle, minimum, and white luminance data wMax, wMid, wMin, and wW into the maximum, middle, minimum, and white data Max', Mid', Min' and W of a luminance level.

The second arrangement part 239 outputs the maximum, middle, minimum, and white data Max', Mid', Min' and W as the second data signal 231, which includes the second red data R', the second green data G', the second blue data B', and the white data W.

For example, when the first red data R has the maximum gradation, the first green data B has the middle gradation, and the first blue data B has the minimum gradation, the second arrangement part 239 outputs the maximum data Max' as the second red data R', the middle data Mid' as the second green data G', and the minimum data Min' as the second blue data B'. The second arrangement part 239 also outputs the white data W.

Consequently, one component of the second data signal R', G', B', and W may always have a gradation of zero due to the processing part 235.

Figure 5:
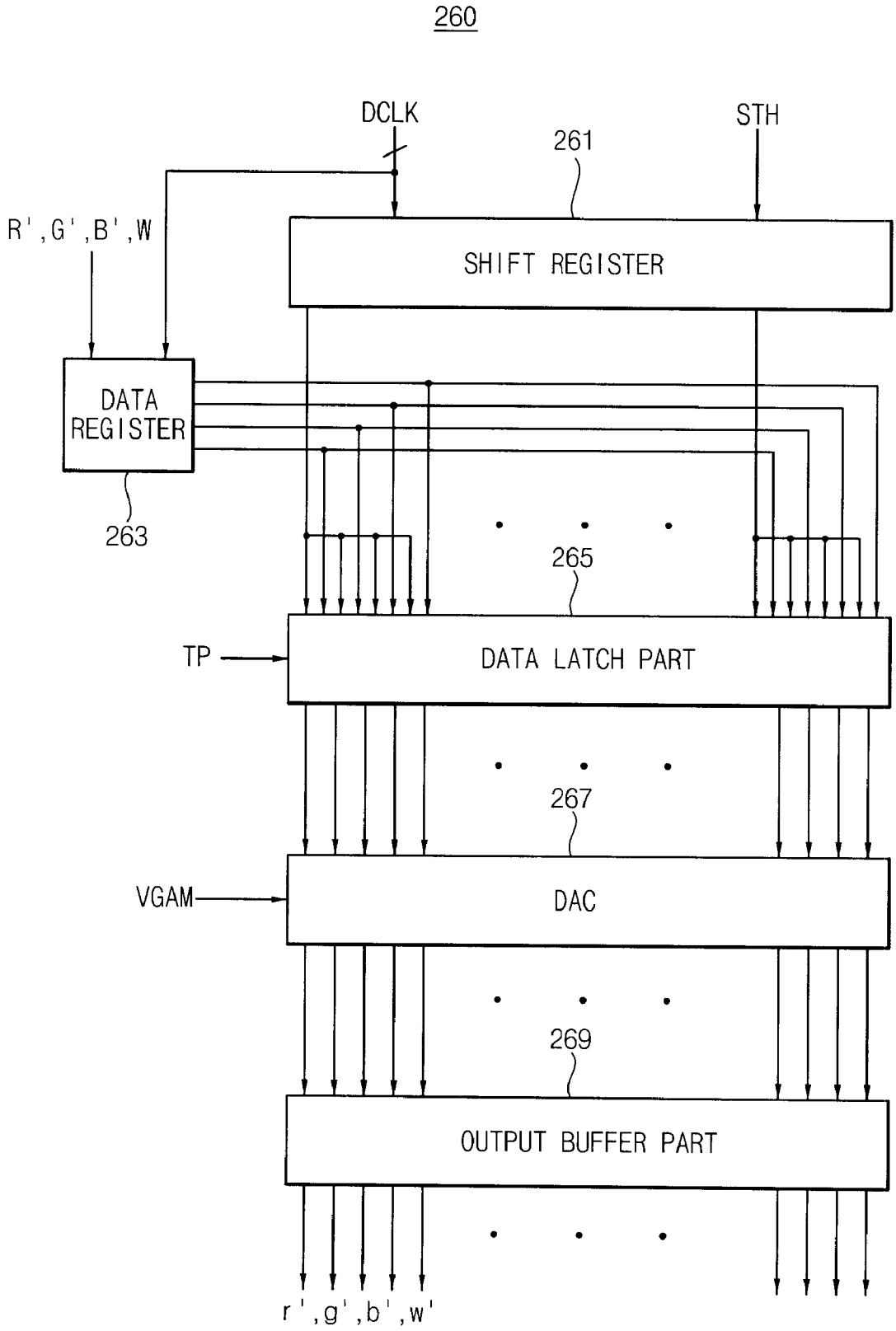
FIG. 5 is a block diagram showing the source drive section of FIG. 1.

FIG. 5 is a block diagram showing the source drive section of FIG. 1.

Referring to FIG. 1 and FIG. 5, the source drive section 260 includes a shift register 261, a data register 263, a data latch part 265, a digital-to-analog converting part DAC 267, and an output buffer part 269.

The shift register 261 receives a horizontal start signal STH and a data clock signal DCLK such as a driving signal provided from the control section 210. The shift register 261 shifts the horizontal start signal STH synchronizing the data clock signal DCLK to generate a sampling signal, and then provides the data latch part 265 with the sampling signal.

The data register 263 provides the data latch part 265 with the second data signal R', G', B', and W provided from the storage section 240 in synchronization with the data clock signal DCLK.

The data latch part 265 includes a plurality of data latches. The data latch part 265 samples the second data signal R', G', B', and W provided from the data register 263 in response to the sampling signal, and then sequentially latches the sampled second data signal R', G', B', and W to the data latches. The data latch part 265 provides the digital-to-analog converting part DAC 267 with the second data signal R', G', B', and W in response to a load signal TP provided from the control section 210.

The digital-to-analog converting part DAC 267 receives the second data signal R', G', B', and W from the data latch part 265. The digital-to-analog converting part DAC 267 converts the second data signal R', G', B', and W into a third data signal r', g', b', and w' (i.e., a data voltage), which is an analog signal, corresponding to a plurality of reference gamma voltages VGAM, and then provides the output buffer part 269 with the third data signal r', g', b', and w'. Here, a color data having a gradation of zero of the second data signal R', G', B', and W is converted into a negative polarity data voltage Vn with respect to the reference voltage Vcom based on the gamma curve shown in FIG. 3, and then output to the output buffer part 269.

The output buffer part 269 includes a plurality of output buffers. The output buffer part 269 buffers the third data signal r', g', b', and w' provided from the digital-analog converting part DAC 267 to be output to the data lines $DL_1$ to $DL_M$.

Figure 6:
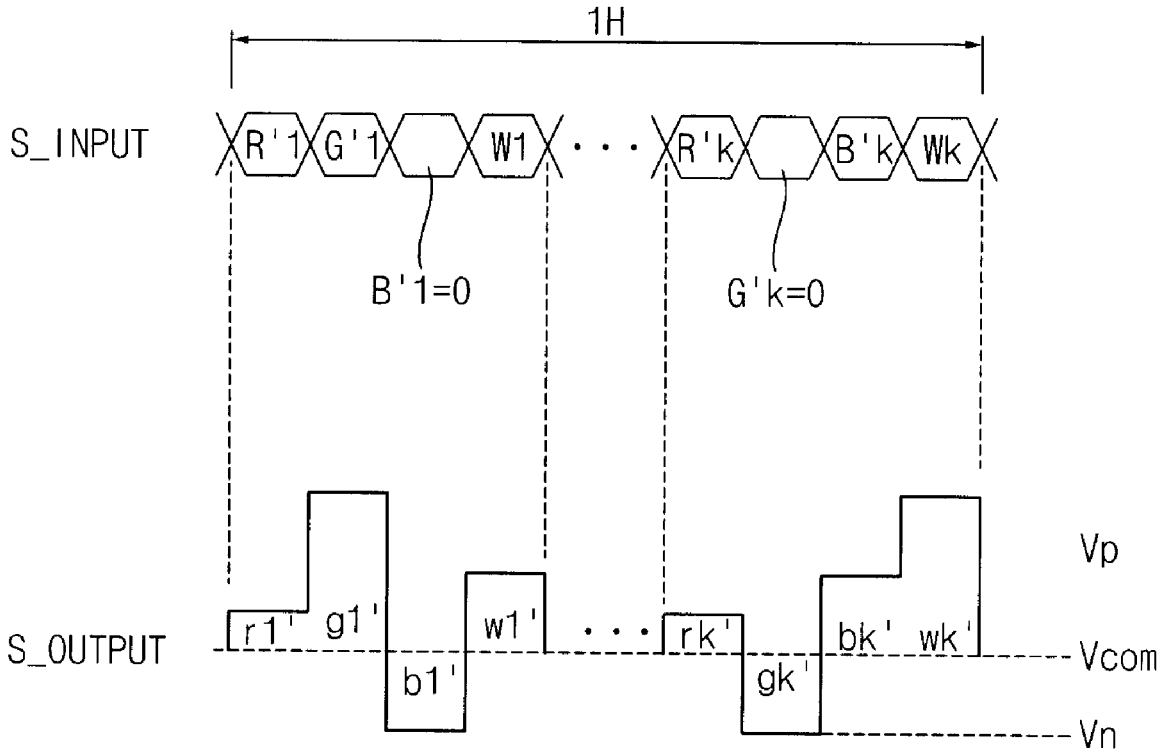
FIG. 6 is a waveform diagram showing input and output signals of the source drive section of FIG. 5.

FIG. 6 is a waveform diagram showing input and output signals of the source drive section of FIG. 5.

Referring to FIG. 5 and FIG. 6, a second data signal S_INPUT corresponding to one horizontal interval 1H is input to the source drive section 260.

For example, red data R'1, green data G'1, blue data B'1, and white data W1 are input corresponding to a first unit pixel part among unit pixel parts of the first horizontal line. Of the data input to the first unit pixel part, the blue data B'1 has a gradation of zero.

The source drive section 260 converts the second data signal R', G', B', and W into a third data signal using the reference gamma voltages VGAM. The third data signal is an analog signal, and it includes a red voltage r', green voltage g', blue voltage b', and white voltage w'. In FIG. 6, the blue voltage b1' corresponding to a first unit pixel part is a negative polarity data voltage Vn, and the green voltage gk' corresponding to a k-th unit pixel part is a negative polarity data voltage Vn.

That is, the red, green, and white voltages r1', g1', and w1' that correspond to the first unit pixel part are converted into a positive polarity data voltage with respect to a reference voltage Vcom, respectively, and the blue voltage b1' having the gradation of zero is converted into a negative polarity data voltage Vn with respect to the reference voltage Vcom. Further, the red, blue, and white voltages rk', bk', and wk' that correspond to the k-th unit pixel part are converted into positive polarity data voltages with respect to a reference voltage Vcom, respectively, and the green voltage gk' having the gradation of zero is converted into a negative polarity data voltage Vn with respect to the reference voltage Vcom.

The source drive section 260 outputs a plurality of color voltage data S_OUTPUT to the OLED display panel 100 corresponding to the second data signal S_INPUT. The color voltage data S_OUTPUT includes a red voltage r', a green voltage g', a blue voltage b', and a white voltage w', and the second data signal S_INPUT includes the red data R'1, the green data G'1, the blue data B'1, and the white data W.

Consequently, positive polarity data voltages are applied to the first, second, and fourth sub-pixels RP, GP, and WP of the first unit pixel part, and a negative polarity data voltage is applied to the third sub-pixel BP.

Accordingly, a negative polarity data voltage may be randomly applied to sub-pixels of the OLED display panel, so that an additional interval for applying a negative polarity data voltage is not necessary and the negative polarity data voltage may be applied to the red, green, and blue sub-pixels, during normal driving of the OLED display device.

As described above, according to exemplary embodiments of the present invention, the three-color data signal R, G, and B is converted into the four-color data signal R, G, B, and W in order to increase the lifetime of the OLED display device, and gradation data of zero that always exists in the data converting process is converted into a negative polarity data voltage to drive the OLED display device.

Accordingly, even though an interval for applying a negative polarity data voltage is not used, the negative polarity data voltage may be applied to the OLED display device during normal driving, so that the lifetime of the OLED display device may be increased.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light-emitting diode (OLED) display device, comprising:

an OLED display panel comprising a plurality of pixels to display a plurality of colors, respectively, each pixel comprising an OLED element;

a gamma voltage-generating section to generate a reference gamma voltage based on a gamma curve in which the lowest gradation of all gradations is mapped as a negative data voltage with respect to a reference voltage;

a data conversion section to convert a first data signal into a second data signal that includes data corresponding to the lowest gradation; and a source drive section to convert the second data signal into a third data signal by using the reference gamma voltage and to provide the third data signal to the OLED display panel, wherein the first data signal comprises first red data, first green data, and first blue data, wherein the second data signal comprises second red data, second green data, second blue data, and white data, and wherein the data conversion section comprises:

a first arrangement part to arrange the first red data, the first green data, and the first blue data in the order of a gradation size;

a first conversion part to convert each of the first red data, the first green data, and the first blue data into first luminance data, second luminance data, and third luminance data, respectively;

a processing part to extract maximum luminance data, medium luminance data, minimum luminance data, and white luminance data by processing the first to third luminance data:

a second conversion part to convert each of the maximum luminance data, the medium luminance data, the minimum luminance data, and the white luminance data into maximum data, medium data, minimum data, and white data, respectively; and a second arrangement part to arrange the maximum data, the medium data, the minimum data, and the white data as the second data signal and to output the second data signal to the source drive section.

2. The OLED display device of claim 1, wherein the source drive section converts the data corresponding to the lowest gradation of the second data signal into the negative data voltage to output the negative data voltage to the OLED display panel.

3. The OLED display device of claim 1, wherein each pixel further comprises:

a switching transistor connected to a data line that receives the third data signal and to a gate line that crosses with the data line; and a driving transistor to drive the OLED element in response to an output signal of the switching transistor.

4. A method for driving an organic light-emitting diode (OLED) display device including an OLED display panel with a plurality of pixels displaying a plurality of colors, respectively, each pixel having an OLED element, the method comprising:

converting a first data signal into a second data signal including a lowest gradation;

converting the lowest gradation of the second data signal into a negative data voltage based on a reference voltage, and converting a gradation of the second data signal that is higher than the lowest gradation into a positive data voltage with respect to the reference voltage; and outputting the data voltages to the OLED display panel, wherein the first data signal comprises first red data, first green data, and first blue data, wherein the second data signal comprises second red data, second green data, second blue data, and white data, and wherein converting a first data signal into a second data signal comprises:

converting each of the first red data, the first green data, and the first blue data into first luminance data, second luminance data, and third luminance data, respectively;

extracting maximum luminance data, medium luminance data, minimum luminance data, and white luminance data by processing the first to third luminance data;

converting each of the maximum luminance data, the medium luminance data, the minimum luminance data, and the white luminance data into maximum data, medium data, minimum data, and white data, respectively; and outputting each of the maximum data, the medium data, the minimum data, and the white data as the second data signal.

5. A display device, comprising:

a display panel comprising a plurality of unit pixels, each unit pixel comprising a first sub-pixel, a second sub-pixel, a third sub-pixel, and a fourth sub-pixel;

a gamma voltage-generating section to generate a reference gamma voltage based on a gamma curve in which the lowest gradation of all gradations is mapped as a negative data voltage with respect to a reference voltage;

a data conversion section to convert a first data signal into a second data signal, the second data signal comprising a first sub-pixel data signal, a second sub-pixel data signal, a third sub-pixel data signal, and a fourth sub-pixel data signal, wherein at least one of the first sub-pixel data signal, the second sub-pixel data signal, the third sub-pixel data signal, and the fourth sub-pixel data signal is always set to the lowest gradation; and a source drive section to convert the second data signal into a third data signal by using the reference gamma voltage and to provide the third data signal to the display panel, wherein the first data signal comprises first red data, first green data, and first blue data, wherein the first sub-pixel data signal, the second sub-pixel data signal, the third sub-pixel data signal, and the fourth sub-pixel data signal comprise second red data, second green data, second blue data, and white data, respectively, and wherein the data conversion section comprises:

a first arrangement part to arrange the first red data, the first green data, and the first blue data in the order of a gradation size;

a first conversion part to convert each of the first red data, the first green data, and the first blue data into first luminance data, second luminance data, and third luminance data, respectively;

a processing part to extract maximum luminance data, medium luminance data, minimum luminance data, and white luminance data by processing the first to third luminance data:

a second conversion part to convert each of the maximum luminance data, the medium luminance data, the minimum luminance data, and the white luminance data into maximum data, medium data, minimum data, and white data, respectively; and a second arrangement part to arrange the maximum data, the medium data, the minimum data, and the white data as the first sub-pixel data signal, the second sub-pixel data signal, the third sub-pixel data signal, and the fourth sub-pixel data signal and to output the first sub-pixel data signal, the second sub-pixel data signal, the third sub-pixel data signal, and the fourth sub-pixel data signal to the source drive section.

6. The display device of claim 5, wherein the source drive section converts the at least one of the first sub-pixel data signal, the second sub-pixel data signal, the third sub-pixel data signal, and the fourth sub-pixel data signal into the negative data voltage to output the negative data voltage to the display panel.

7. The display device of claim 5, wherein each sub-pixel comprises:

an organic light emitting element;

a switching transistor connected to a data line that receives the third data signal and to a gate line that crosses with the data line; and a driving transistor to drive the organic light emitting element in response to an output signal of the switching transistor.

* * * * *